US008375499B1

(12) United States Patent
Marino

(10) Patent No.: US 8,375,499 B1
(45) Date of Patent: Feb. 19, 2013

(54) ERGONOMICALLY-CONFIGURED HANDLE FOR CLEANING DEVICES

(76) Inventor: Richard Lee Marino, Muncy, PA (US)

( * ) Notice: Subject to any disclaimer, the term of this patent is extended or adjusted under 35 U.S.C. 154(b) by 0 days.

(21) Appl. No.: 12/875,798

(22) Filed: Sep. 3, 2010

Related U.S. Application Data

(60) Provisional application No. 61/242,850, filed on Sep. 16, 2009.

(51) Int. Cl.
*B25G 1/10* (2006.01)

(52) U.S. Cl. ..... 15/143.1; 15/144.1; 16/430; 16/436; 16/DIG. 41; 56/400.01; 56/DIG. 18; 294/57; D4/138; D8/107; D32/50; D32/51

(58) Field of Classification Search ..... 15/143.1, 15/144.1, 410; 16/430, 436, DIG. 41; 56/400.01, 56/DIG. 18; 294/57; D4/138; D8/107; D32/50, D32/51
See application file for complete search history.

(56) References Cited

U.S. PATENT DOCUMENTS

| | | | | |
|---|---|---|---|---|
| 2,753,579 | A | 9/1950 | Kussmann | |
| 2,634,451 | A * | 4/1953 | Dow | 15/323 |
| 3,222,699 | A * | 12/1965 | Zeisig | 7/158 |
| 3,506,996 | A * | 4/1970 | Brennan | 15/144.1 |
| D247,212 | S | 2/1978 | Welch | |
| 4,809,388 | A | 3/1989 | Dietrich | |
| 5,165,144 | A * | 11/1992 | Nisenbaum | 16/421 |
| 5,791,006 | A | 8/1998 | Anctil | |
| D413,234 | S | 8/1999 | Spear | |
| 6,058,551 | A * | 5/2000 | Tagliavini | 15/172 |
| 6,170,112 | B1 | 1/2001 | Mayfield et al. | |
| 6,203,626 | B1 | 3/2001 | Biggs et al. | |
| 6,487,747 | B2 | 12/2002 | Cavalheiro | |
| D482,875 | S * | 12/2003 | Greenberg | D4/138 |
| 7,617,572 | B2 | 11/2009 | Hovsepian et al. | |
| 2003/0150478 | A1 * | 8/2003 | Biggs | 134/6 |
| 2004/0055099 | A1 | 3/2004 | Greenberg | |

* cited by examiner

*Primary Examiner* — Mark Spisich
(74) *Attorney, Agent, or Firm* — Wendy W. Koba

(57) ABSTRACT

An ergonomically-configured handle for tools such as cleaning devices and, more particularly, to a handle for a broom or mop (for example) is formed with curved end terminations to reduce back strain and provide ease of use. A first curved end termination is attached to a tool head (such as a brush, rake head or the like) via an elbow joint. A straight section of handle is then attached to the first curved end termination, where a second curved end termination is then attached to the opposite end of the straight section. A handle grip may be disposed over the termination of the second curved end termination.

4 Claims, 2 Drawing Sheets

ERGONOMICALLY-CONFIGURED HANDLE FOR CLEANING DEVICES

CROSS-REFERENCE TO RELATED APPLICATIONS

This application claims the benefit of U.S. Provisional Application No. 61/242,850, filed Sep. 16, 2009 and incorporated herein by reference.

TECHNICAL FIELD

The present invention relates to an ergonomically-configured handle for cleaning devices and, more particularly, to a handle for a broom or mop (for example) that is formed with curved end terminations to reduce back strain and provide ease of use.

BACKGROUND OF THE INVENTION

Facilities such as auditoriums, movie theaters, and the like require frequent cleaning—such as between movie showings, ball games, etc. Sweeping between the seats has always been a problem. Conventional wooden brooms repeatedly break and cannot easily fit between adjoining seats. Around the house, there are many obstacles and crevices that hinder the use of a conventional broom. Standard push brooms are not forgiving in tight areas—resulting in furniture, molding and walls being constantly marked and dented.

There are a variety of different prior art solutions to this problem. U.S. Pat. No. 2,753,579 issued to T. C. Kussman on Jul. 10, 1956 discloses a push broom having a construction specifically adapted for cleaning of floor surfaces under objects such as chairs, theater seats, church pews and store counters. The Kussman push broom has a handle such as to permit the brush head to be entered under a chair (or the like) while still holding the brush head perfectly square with the floor for most efficient cleaning of the floor surface. The handle of the Kussman push broom includes an upwardly and angularly extending main portion that allows for an individual to grasp the handle while the brush head remains on the floor.

U.S. Pat. No. 4,809,388 issued to R. J. Dietrich discloses a portable surface treating apparatus including a non-straight elongate handle with spaced ends. In a preferred form, the handle has a straight section which is connected to the head so that with the head in position against the floor, the straight section is substantially horizontal. A second straight section is connected in an angular arrangement with the first straight section, at an angle that allows for an individual to grasp this second section without needing to bend over.

Another prior art arrangement is disclosed in U.S. Pat. No. 6,170,112 issued to R. Mayfield et al. on Jan. 9, 2001, where the Mayfield et al. push broom includes a "bowed" handle that is operable with less force than required in using a straight-handled broom. The handle includes a posterior portion that angles upwardly and rearwardly from a front handle portion, thereby orienting the rear, upper end n a more nearly vertical position than a standard push broom.

A curved handle prior art push broom configuration is disclosed in U.S. Pat. No. 6,487,747 issued to F. Cavalheiro on Dec. 2, 2002, where this handle includes a first curved section and a second curved section, each having a specified, different radius of curvature. The two sections blend smoothly into each other at a midpoint, the curvature intended to reduce back strain by the individual using the broom.

While there are various prior art attempts at addressing the problem of cleaning underneath objects, a need remains for a broom/mop handle that allows for quick and efficient cleaning in various hard-to-reach locations.

SUMMARY OF THE INVENTION

The needs remaining in the prior art are addressed by the present invention, which relates to an ergonomically-configured handle for tools such as cleaning devices and, more particularly, to a handle for a broom or mop (for example) that is formed with curved end terminations to reduce back strain and provide ease of use.

In accordance with the present invention a tool handle is formed to include a pair of curved end terminations with a straight section of handle attached therebetween. A first curved end termination is attached to a tool head (such as a brush, rake head or the like) via an elbow joint. The straight section of handle is then attached to the first curved end termination, where the second curved end termination is then attached to the opposite end of the straight section. A handle grip may be disposed over the termination of the second curved end termination.

The various components may be integrally formed form a single piece of material, with the desired curvatures imparted to the opposing end terminations. Alternatively, separate pieces of material may be used to form each section, where the sections are thereafter joined together. The pieces may be permanently joined, or joined so as to be removably attached. In a removable arrangement, straight sections of different lengths may be used, depending on a particular task or the size of the person using the tool. Preferably, the tool is formed as a unitary component from a single piece of material (e.g., anodized aluminum), including both the straight section and the curves.

In another embodiment of the present invention, a straight extension piece may be disposed between the first curved end section and the elbow joint to provide additional ability for the tool to reach under objects and clean in hard-to-reach areas.

These and other embodiments and features of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 1:
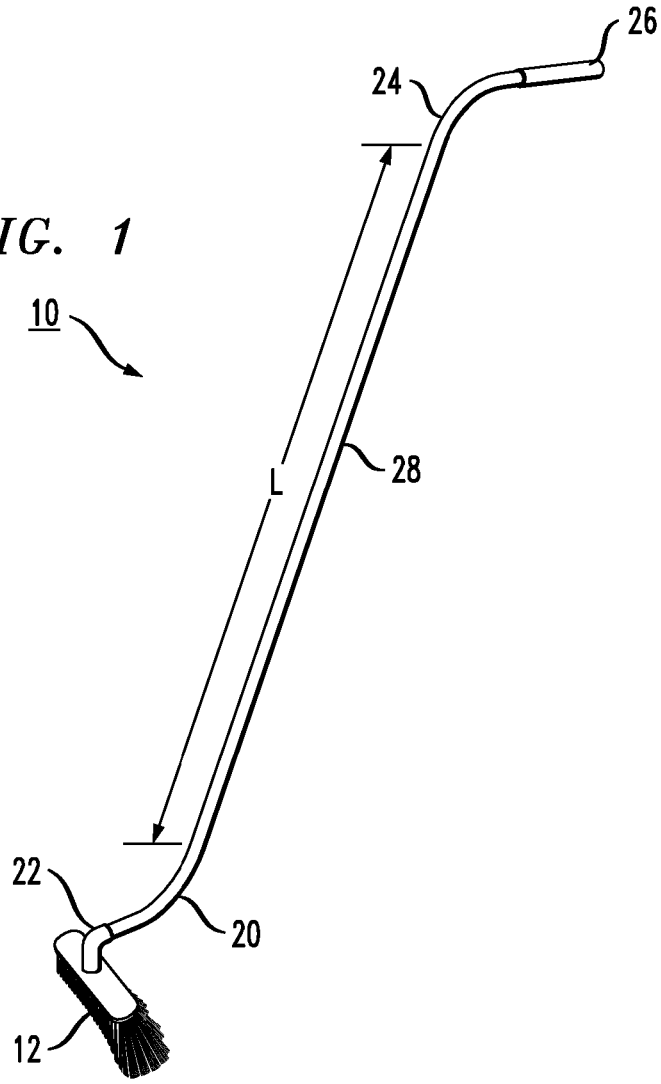
FIG. 1 illustrates a broom including a handle having curved end terminations formed in accordance with the present invention.

FIG. 1 illustrates an exemplary handle 10 formed in accordance with the present invention. In the arrangement of FIG. 1, handle 10 is attached to a broom head 12. It is to be understood that handle 10 may just as easily be used with a mop head, rake, or any other cleaning device.

As shown, handle 10 includes a first curved end section 20 which terminates with an elbow joint 22. An opposing, second curved end section 24 is shown as terminating with a handle grip 26. Between curved sections 20 and 24 is a straight section 28 of broom handle, where the length L of section 28 is designed to suit a particular purpose and/or size of person using the handle.

Figure 2:
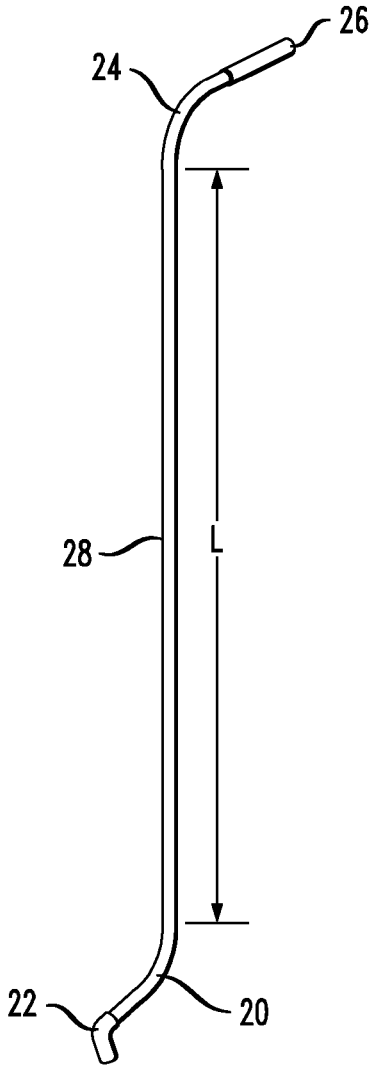
FIG. 2 is a detailed view of the inventive handle as shown in FIG. 1.
Figure 3:
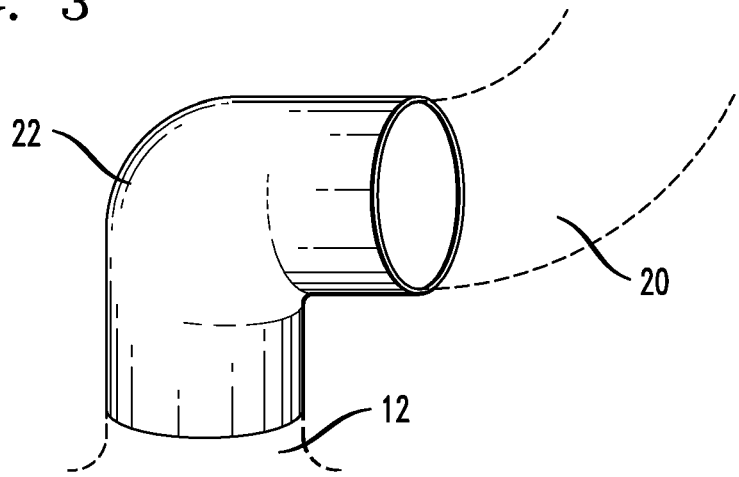
FIG. 3 is a detailed view of an elbow joint as connected to a first curved end termination of the inventive handle.

FIG. 2 is a side view of handle 10, in this case without showing a broom head being attached thereto. Evident in this view is the curvature of sections 20 and 24. It is an aspect of the present invention that elbow joint 22 is permanently attached to the termination of curved section 20. In one case, elbow joint 22 may be a rotatable element, such that the "cleaning head" attached thereto can be movably oriented with respect to the handle (useful when attempting to clean along crevices, for example). Alternatively, elbow joint 22 may be a fixed component, while still allowing for different types of cleaning heads to be attached thereto. FIG. 3 illustrates an exemplary elbow joint 22, showing in phantom the connections to first curved section 20 of handle 10 and (for example) broom head 12.

Figure 4:
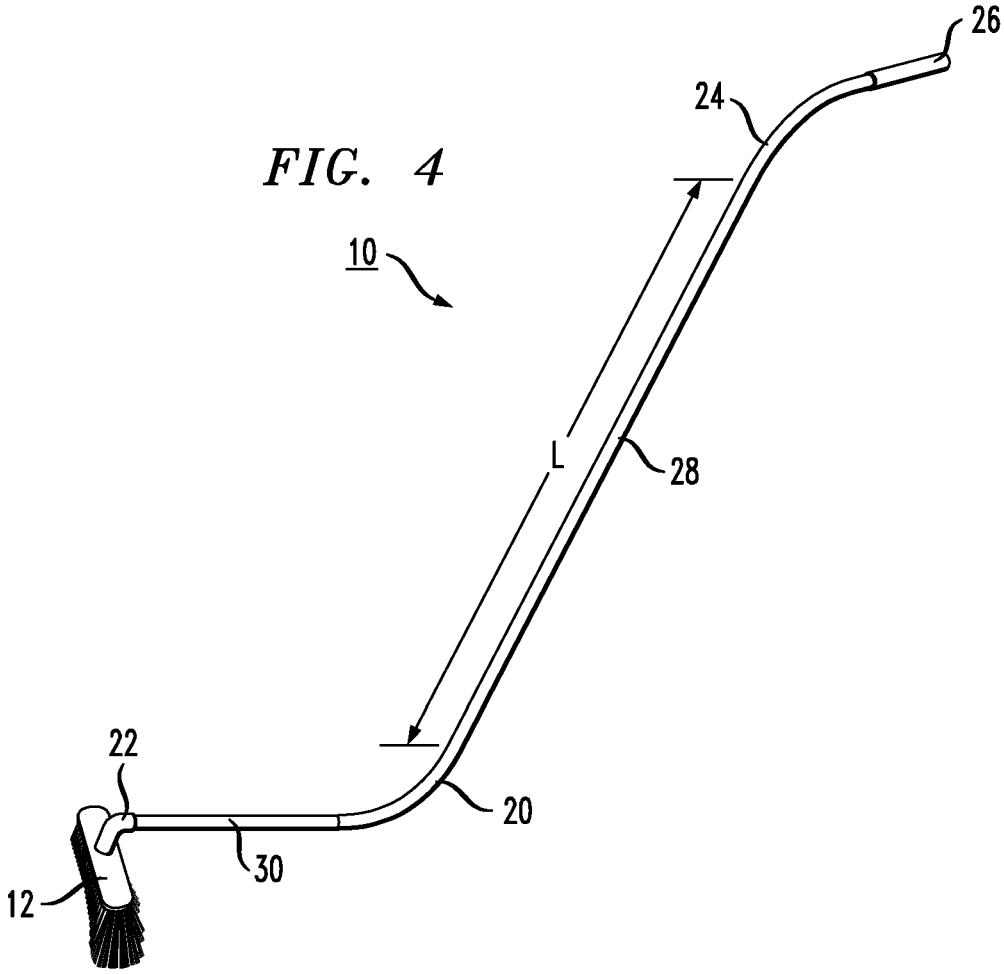
FIG. 4 illustrates a broom including an alternative embodiment handle of the present invention, in this case including an straight extension piece disposed beyond one of the curved end terminations.

It is to be understood that various other extensions may be added to the basic structure of the inventive curved handle of the present invention. FIG. 4 illustrates one alternative embodiment where an additional straight handle section 30 is added to curved section 20, in this case to provide extra ability to reach under low seats, couches or the like. Handle section 30 is shown as terminating in elbow joint 22. In one case, section 30 can be formed as a removable attachment to curved section 20; alternatively, section 30 may be permanently attached to curved section 20 or formed as an integral part of the same material forming section 20, merely allowing section 20 to terminate in a 'straight' section as it attaches to elbow joint 22.

In a preferred embodiment, handle 10 is formed of an anodized aluminum material, which is sturdy, yet lightweight. Elbow joint 22 generally comprises a lightweight plastic material, such as polyvinylchloride (PVC). However, it is to be understood that the ergonomically-configured handle of the present invention may be formed of any other material suitable for this purpose.

While the present invention has been described in connection with exemplary embodiments thereof, it is to be understood that many modifications will be apparent to those skilled in the art. This application is thus intended to cover any adaptations or variations thereof which may be contemplated by those having such skill. Indeed, it is intended that the scope of the subject matter of the present invention is intended to be limited only by the claims appended hereto.

What is claimed is:

1. A handle for use with a tool head comprising a first curved end section;

a second, opposing curved end section;

a straight handle section disposed between the first curved end section and the second, opposing curved end section; and an elbow joint comprising first and second portions thereof being disposed substantially perpendicular to each other and having generally the same lengths, one of the portions of the elbow joint being directly coupled to and extending from a curved terminal portion of the first curved end section and the other portion being adapted to attach to a tool head, wherein the length of the straight handle section is greater than the distance between the elbow joint and the first curved end section, the straight handle section being the major portion of the total overall length of the handle.

2. A handle as defined in claim 1 wherein the elbow joint is fixed and incapable of rotation.

3. A handle as defined in claim 1 wherein the elbow joint swivels and is capable of rotation.

4. A handle as defined in claim 1 wherein the handle further comprises a hand grip attached to a terminal end portion of the second, opposing curved end section.

* * * * *